US006068179A

United States Patent [19]

Fowler

[11] Patent Number: 6,068,179

[45] Date of Patent: May 30, 2000

[54] HEAT EXCHANGER MANUFACTURE

[75] Inventor: John O Fowler, Derby, United Kingdom

[73] Assignee: Rolls-Royce plc, London, United Kingdom

[21] Appl. No.: 09/126,928

[22] Filed: Jul. 31, 1998

[30] Foreign Application Priority Data

Aug. 2, 1997 [GB] United Kingdom ..... 9716288

[51] Int. Cl.[7] ..... B23K 20/00; B23K 20/18

[52] U.S. Cl. ..... 228/157; 228/190

[58] Field of Search ..... 228/157, 175, 228/182, 190, 193, 212, 118

[56] References Cited

U.S. PATENT DOCUMENTS 2,333,343 11/1943 Sendzimir .
4,292,375 9/1981 Ko ..... 428/593
5,070,607 12/1991 Boardman et al. .
5,287,918 2/1994 Banks et al. .
5,383,518 1/1995 Banks et al. .
5,385,204 1/1995 Boardman et al. .
5,465,484 11/1995 Banks et al. .
5,465,785 11/1995 Adderley et al. .
5,573,060 11/1996 Adderley et al. .

*Primary Examiner*—Samuel M. Heinrich
*Attorney, Agent, or Firm*—W. Warren Taltavull; Farkas & Manelli PLLC

[57] ABSTRACT

It is the norm to make diffusion bonded and superplastically formed heat exchanger panels from a trio of three sheet stacks, which employs four diffusion bonding stages and three superplastic forming stages. The concept described and claimed obviates one sheet from the central stack and provides only one passageway between the remaining two sheets. The advantages gained include less material and one bonding/superplastic forming stage is obviated with resulting savings in cost, time and machine utilization.

18 Claims, 2 Drawing Sheets

HEAT EXCHANGER MANUFACTURE

The present invention relates to the manufacture of heat exchanger devices, wherein liquids and or gases are caused to flow through adjacent passageways in a panel structure.

It has already been appreciated that certain metals which are capable of being treated so as to have superplastic characteristics, can be manipulated so as to produce panels which have passageways therein, thus obviating the need to pre-form individual, intricate shapes, which then have to be welded or brazed to skin covers, a task which is both difficult and expensive. Cost reductions are considerable when the former method is used.

Present technological levels of manufacture of heat exchangers are such as to enable panels, each consisting of at least three sheets of metal, e.g. titanium, to be manufactured as separate flat laminates, treated with an anti diffusion bond material e.g. Yttria, in local places, and then stacked and diffusion bonded, to create a desired thickness of now integral structure i.e. a structure with no joints or faying faces.

The next step in the process is to place the structures in a die and superplastically inflate it in known manner, so as to form fluid passageways in those areas where diffusion bonding has been prevented.

Further improvements are being sought, and the present invention provides such an improvement of manufacturing heat exchanger panels.

According to the present invention a method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) preparing two further sheets of a superplastically formable metal, at least one of which has a major portion of its faying face coated with a said anti diffusion bonding material such as to leave a peripheral area thereof exposed and preparing a frame formed from a superplastically formable metal, f) stacking the two, three sheet, integral structures, the two further sheets and the frame such that the two further sheets and the frame are sandwiched between the two, three sheet, integral structures, g) sealing the abutting edges of the two, three sheet, integral structures, the two further sheets and the frame to form a module, h) placing the module in an appropriately shaped die and heating the module to a temperature conducive to superplastic forming, and then i) applying an inert gas under pressure into the rows of internal passageways of the two, three sheet, integral structures and between those faying faces of the two further sheets where anti diffusion bonding material was applied, so that one of the two further sheets moves away from the other of said two further sheets, to form a single passageway centrally of the whole and to diffusion bond the two, three sheet, integral structures, the two further sheets and the frame together to form an integral module.

Step (e) may include stacking the two further sheets together, diffusion bonding each separate two sheet stack to form an integral structure and applying the frame to the periphery of the outer surface of one of said two sheets of the two sheet integral structure, step (f) includes stacking the two, three sheet, integral structures, with the two sheet integral structure and the frame sandwiched therebetween, and step (i) includes applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

Step (e) may include stacking the two further sheets together, locating the frame between the peripheries of the inner surfaces of said two sheets of the two sheet stack, diffusion bonding each separate two sheet stack and frame to form an integral structure, step (f) includes stacking the two, three sheet, integral structures, with the two sheet integral structure and frame sandwiched therebetween, and step (i) includes applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

Step (e) may include stacking the two further sheets together, applying the frame to the periphery of the outer surface of one of said two sheets, step (f) includes stacking the two, three sheet, integral structures, with the two further sheets and the frame sandwiched therebetween, step (i) includes applying an inert gas under pressure into the rows of internal passageways of the three sheet integral structures and between those faying faces of the two further sheets where anti diffusion bonding material was applied, so that one of the two further sheets moves away from the other of said two further sheets, to form a single passageway centrally of the whole and to diffusion bond the three sheet integral structures, the two further sheets and the frame together to form an integral module.

Preferably titanium or an alloy thereof is used as the superplastically formable metal.

Preferably argon is used as the inert gas.

Preferably yttria is used as the anti diffusion bonding material.

Different alloys may be used for the three sheets in step (a) and the two further sheets used in step (e).

Different alloys may be used for the three sheet stack in step (a) and the frame in step (e).

Inert gas may be supplied into the two sheet integral structure at a temperature at which the sheets are plastic to break the adhesive bond between the sheets.

Preferably each three sheet stack is weld sealed around its edges after step (a) and before step (b).

Preferably each two sheet stack is weld sealed around its edges before diffusion bonding.

Preferably at least one turbulator is located between the one of the two further sheets abutting the frame and the integral structure.

Different alloys may be used for the at least one turbulator and the three sheet stack in step (a).

Different alloys may be used for the at least one turbulator and the two further sheets of step (e).

The present invention also provides a method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) stacking two further sheets of a superplastically formable metal, at least one of which has a major portion of its faying face coated with a said anti diffusion bonding material such as to leave a peripheral area thereof exposed, f) diffusion bonding each separate two sheet stack to form an integral structure, g) applying a frame formed from a superplastically formable metal to the periphery of the outer surface of one of said two sheets of the two sheet integral structure, h) stacking the two, three sheet, integral structures, with the two sheet integral structure and frame sandwiched therebetween, i) weld sealing the edges of one of the three sheet integral structures to the frame, weld sealing the edges of the two sheet integral structure to the frame and weld sealing the edges of the other three sheet integral structure to the two sheet integral structure to form a module, j) placing the module in an appropriately shaped die and heating the module to a temperature conducive to superplastic forming, and then k) applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

The present invention also provides a method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) stacking two further sheets of a superplastically formable metal, at least one of which has a major portion of its faying face coated with a said anti diffusion bonding material such as to leave a peripheral area thereof exposed, locating a frame formed from a superplastically formable metal between the peripheries of the inner surfaces of said two sheets of the two sheet stack, f) diffusion bonding each separate two sheet stack and frame to form an integral structure, g) stacking the two three sheet integral structures, with the two sheet integral structure and frame sandwiched therebetween, h) weld sealing the edges of one of the three sheet integral structures to the two sheet integral structure and weld sealing the edges of the other three sheet integral structure to the two sheet integral structure to form a module, i) placing the module in an appropriately shaped die and heating the module to a temperature conducive to superplastic forming, and then j) applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

The present invention also provides a method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) stacking two further sheets of a superplastically formable metal, at least one of which has a major portion of its faying face coated with a said anti diffusion bonding material such as to leave a peripheral area thereof exposed, f) applying a frame formed from a superplastically formable metal to the periphery of the outer surface of one of said two sheets, g) stacking the two, three sheet, integral structures, with the two further sheets and the frame sandwiched therebetween, h) weld sealing the edges of one of the three sheet integral structures to the frame, weld sealing the edges of one of the two further sheets to the frame, weld sealing the edges of the two further sheets and weld sealing the edges of the other three sheet integral structure to the other of the two further sheets to form a module, j) placing the module in an appropriately shaped die and heating the module to a temperature conducive to superplastic forming, and then k) applying an inert gas under pressure into the rows of internal passageways of the three sheet integral structures and between those faying faces of the two further sheets where anti diffusion bonding material was applied, so that one of the two further sheets moves away from the other of said two further sheets, to form a single passageway centrally of the whole and to diffusion bond the three sheet integral structures, the two further sheets and the frame together to form an integral module.

The invention will now be described, by way of example and with reference to the accompanying drawings in which.

Figure 1:
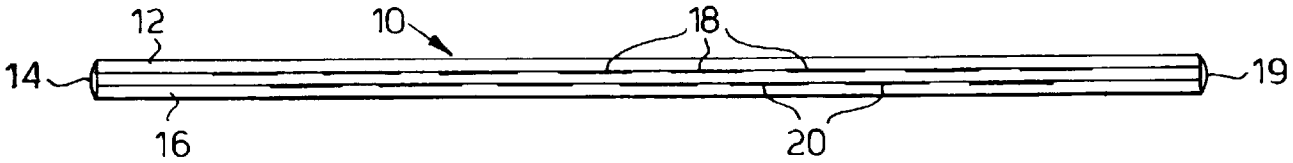
FIG. 1 is a side edge view of a three sheet stack in accordance with the present invention.

Referring to FIG. 1. Two stacks 10 are made, only one stack 10 being shown, each consisting of three sheets of titanium 12, 14 and 16, the centre sheet 14 of which, has had a desired pattern of yttria applied to both sides, the yttria being held in place by a suitable known adhesive. Each stack 10 is then welded around their edge 19 to seal them as well as to hold them together. The yttria is represented by short, thickened lines 18 and 20.

Prior to assembly of the sheets 12, 14 and 16, notches (not shown) are cut in their edge peripheries in known manner, for the fitting of pipes such that their inner ends are aligned with the areas covered by yttria; this being for the purpose of enabling a flow of inert gas thereto, as is described later in their specification.

The stacks 10 are then evacuated by means of the pipes and the stacks 10 are heated to remove volatile binders from the anti diffusion bonding material while being continuously evacuated. After the volatile binders have been removed the pipes are sealed with the inside of the stacks remaining at vacuum pressure.

The three sheets 12,14 and 16 in the stacks 10 are then diffusion bonded by being enclosed in individual vacuum bags and subjected to hot isostatic pressure in an autoclave. Alternatively the stacks 10 may be placed in a hot isostatic pressing (HIP) vessel to diffusion bond the stacks 10. There results two, three sheet, integral structures, or panels, in each case separated only in those areas containing the yttria which is an anti diffusion bonding substance. The two, three sheet, integral structures, or panels, have the pipes removed and fresh pipes are fitted.

The resulting three sheet integral structures, or panels, are placed in a die which has a cavity when in situ, and the whole is heated to a temperature suitable for superplastic forming, about 900 degrees C. for titanium. An inert gas such as argon is introduced into the areas containing the yttria in known manner via the aforementioned pipes (not shown), causing ex sheet 12 of the stacks 10, to move into the cavity 36, pulling the ex sheet 14 with it at those places where diffusion bonding had occurred to form a row of passageways 42. Superplastic forming of the ex sheet 12 occurs only where it is stretched along the end walls of the die, and superplastic forming of the ex sheet 14 occurs only in those portions which have been prevented from diffusion bonding by the presence of yttria.

Figure 2:
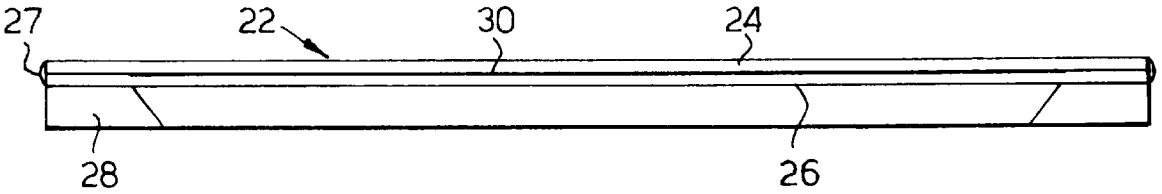
FIG. 2 is a side edge view of a two sheet stack in accordance with the present invention.

Referring to FIG. 2. A further stack, 22 is made and consists of two sheets of titanium 24 and 26. Yttria is bonded on to the whole of the surface area on the faying face of one of the sheets 24 or 26, which area equals the area bounded by the interior periphery of the frame 28, the yttria layer being indicated by the numeral 30. The sheets 24, 26 are also edge welded, as indicated by the numeral 27.

Prior to assembly of the sheets 24 and 26, notches (not shown) are cut in their edge peripheries in known manner, for the fitting of pipes such that their inner ends are aligned with the areas covered by yttria; this being for the purpose of enabling a flow of inert gas thereto, as is described later in the specification.

The stack 22 is then evacuated by means of the pipes and the stack 22 is heated to remove volatile binders from the anti diffusion bonding material while being continuously evacuated. After the volatile binders have been removed the pipes are sealed with the inside of the stacks remaining at vacuum pressure.

The two sheets 24 and 26 in the stack 22 are then diffusion bonded by being enclosed in individual vacuum bags and subjected to hot isostatic pressure in an autoclave. Alternatively the stack 22 may be placed in a hot isostatic pressing (HIP) vessel to diffusion bond the stack 22. There results a single, two sheet, integral structure, or panel, in each case separated only in those areas containing the yttria which is an anti diffusion bonding substance. The single, two sheet, integral structure, or panel, has the pipe removed and a fresh pipe is fitted.

Figure 3:
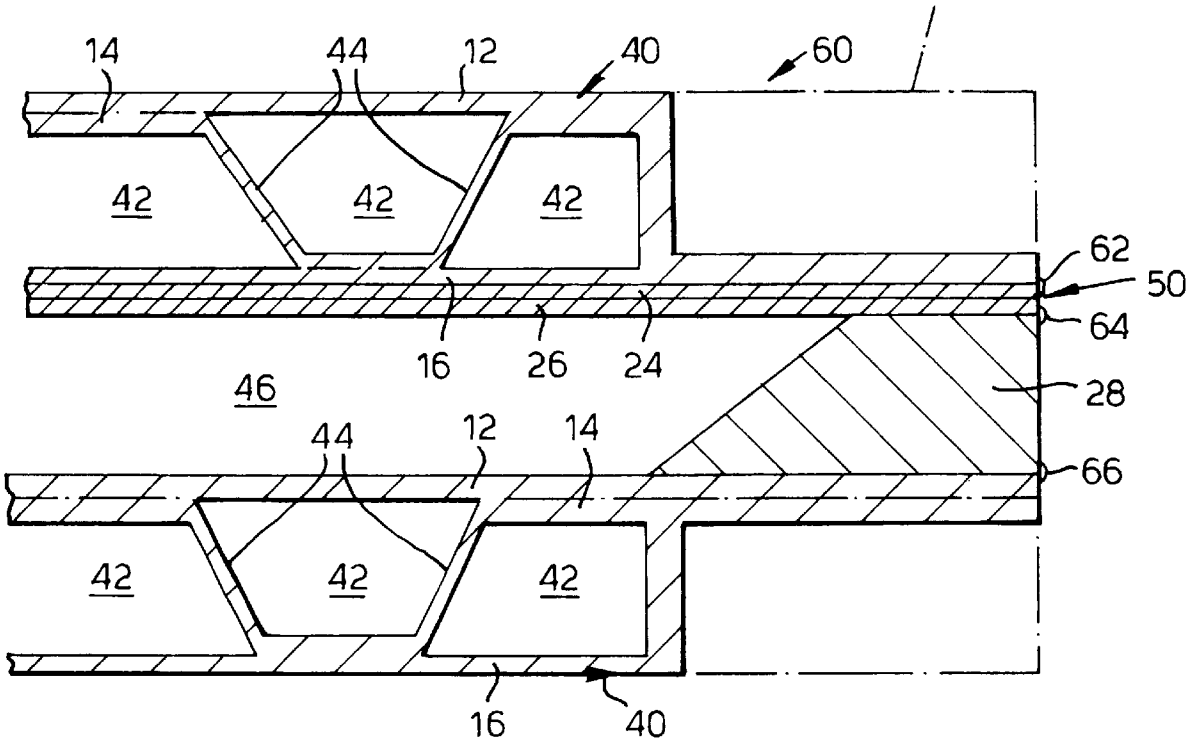
FIG. 3 is a part view of a module comprising two, three sheet, integral structures made from the stack of FIG. 1 sandwiching a two sheet integral structure of FIG. 2 and a frame.

Referring to FIG. 3. The three integral structures, two of the three sheet integral structures 40 and one two sheet integral structure 50, are now assembled into a single module 60 together with a titanium frame 28. The two sheet integral structure 50 and the frame 28 are sandwiched between the two, three sheet, integral structures 40. The titanium frame 28 abuts the periphery of one major face of one of the ex sheets, in the present example, the under sheet 26 of the integral structure 50 and abuts the periphery of one major face of one of the ex sheets, in the present example, the top sheet 12 of one of the integral structures 40. The major face of one of the ex sheets, in the present example, the top sheet 24 of the integral structure 50 abuts the major face of one of the ex sheets, in this example, the under sheet 16 of the other integral structure 40.

The module 60 is then welded around its edges at 62,64 and 66 to seal the space between one of the integral structures 40 and the integral structure 50, to seal the space defined between the other integral structure 40, the integral structure 50 and the frame 28.

The resulting module 60 of three integral structures 40 and 50, or panels, and frame 28 are placed in a die and the whole is heated to a temperature suitable for superplastic forming, about 900 degrees C. for titanium. An inert gas such as argon is introduced into the areas of the integral structure 50 containing the yttria in known manner via the aforementioned pipes (not shown), and the inert gas is introduced into the rows of passageways 42 in each of the integral structures 40. The space 46 defined between the other integral structure 40, the integral structure 50 and the frame 28 is evacuated.

The inert gas is introduced into the areas of the integral structure 50 containing the yttria and the rows of passageways 42 in the integral structures 40 such that one of the ex sheets, in this example, under sheet 26 of the integral structure 50 superplastically extends to abut against the frame 28 and against the surface of the ex sheet 12 of the integral structure 40 before the ex sheet 24 diffusion bonds with the ex sheet 16 of the upper integral structure 40 and the ex sheet 26 of the integral structure 50 diffusion bonds with the ex sheet 12 of the lower integral structure 40 and the frame 28 diffusion bonds with the lower integral structure 40 to form an integral module 70 and to ensure that the integral structures 40 do not become deformed.

The faying faces of the upper integral structure 40 and the integral structure 50 are diffusion bonded over their total areas, so as to form a thicker structure portion. The frame 28 diffusion bonds to the lower integral structure 40 and a single passageway results, which is defined by the upper integral structure consisting of the integral structures 40 and 50, the frame 28 and the lower integral structure 40. The ex sheet 26 only superplastically extends where it is forced onto the inner surface of the ex frame 28.

It is preferred to supply an inert gas such as argon into the areas of the integral structure 22 containing the yttria in known manner via the aforementioned pipes (not shown), at room temperature while the ex sheets 24 and 26 are elastic to break the adhesive bond between the ex sheets 24 and 26 due to the diffusion bonding step, before the superplastic forming step, to ensure that the ex sheet 26 superplastically extends to abut the sheet 12 before diffusion bonding occurs.

The term "ex" is used herein, in the context of the structure, having been assembled, diffusion bonded and expanded, is now a totally solid artefact, except of course, for the passageways which have been formed therein, and which are described hereinafter.

Figure 4:
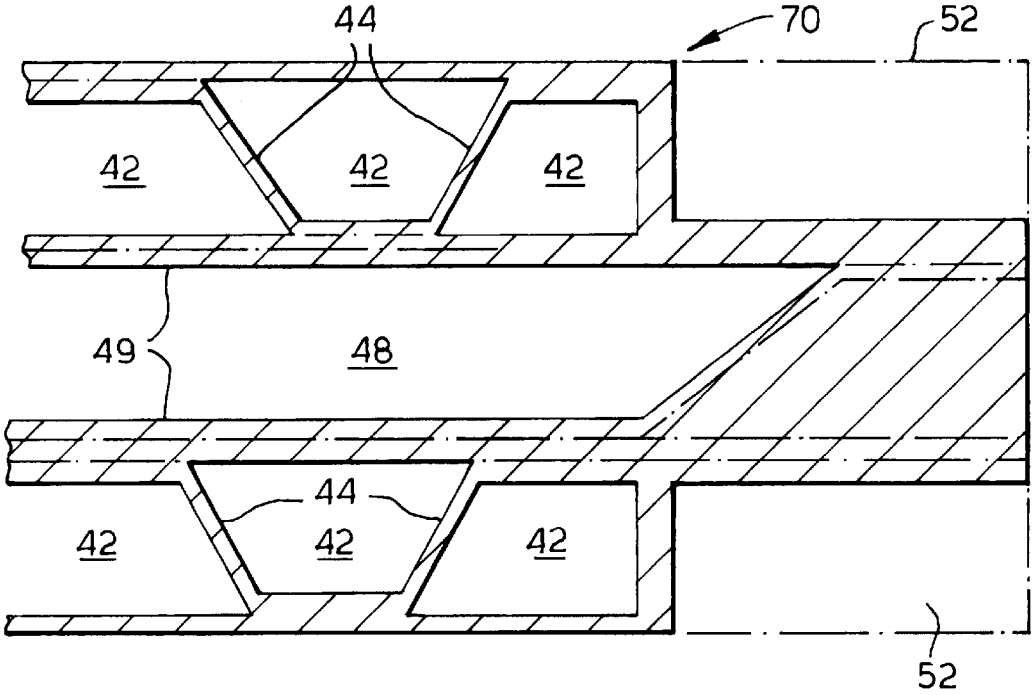
FIG. 4 is a part view of the module of FIG. 3 after superplastic forming and diffusion bonding in accordance with the present invention to form an integral module.

Referring now to FIG. 4. The structure formed by the method described hereinbefore consists of an integral module 70 of titanium which has two rows of side by side, elongated passageways 42, each passageway 42 is separated from an adjacent passageway 42, by superplastically stretched portions 44 of ex sheet 14 and a single elongate passageway 48 is positioned centrally of the two rows of said passageways 42.

In operation as a heat exchanger element, hot fluid would be caused to flow through the passageways 42 and a cold, heat extracting fluid to flow through the central passageway 48, to extract heat from the hot fluids by conduction thereof through dividing walls 49.

Each of the stacks of three sheets 12, 14, 16 may include stiffening frames 52 if desired, as show in chain dotted lines.

The structure has numerous advantages not enjoyed by prior art structures which have a plurality of central passageways, in the manner or the outer passageways. Some of those advantages are as follows:

a) Fluid pressures across the heat exchanging walls provide sufficient internal forces, as to support the structure in its operating mode.

b) One sheet of material is obviated, thus saving on cost, simplifying assembly, and reducing machining time and usage of machines, by way of having fewer sheets to machine per assembly and further it combines the superplastic forming of the two sheet integral stack with the bonding of the three integral stacks into an integral module.

c) The uncluttered central passageway 48 is more amenable to the fitting of turbulence generators i.e. small pieces of titanium, not shown, which may be bonded to the walls of passageway 48, if desired, so as to cause turbulence in the flow of fluid therethrough, and so increase cooling efficiency. The turbulence generators are preferably located in the chamber 46 on the surface the ex sheet 12 of lower integral structure 40 such that when sheet 26 is superplastically extended the sheet 26 is deformed around the turbulence generators and then diffusion bonds to the ex sheet 12 and the turbulence generators. This enables the turbulence generators to be of lower cost titanium and possibly of a material which is not corrosion resistant, because they are not directly in contact with the fluid in the passageway 48.

d) The sheets 24 and 26, and frame 28 may be made from lower cost titanium alloys, and the turbulence generators if included may be made from lower cost titanium alloys.

In an alternative method of manufacture according to the present invention it is possible to position the frame 28 between the sheets 22 and 24 of the stack 22 and to weld seal the edges together. Then the stack 22 is diffusion bonded together to form an integral structure. Thereafter, the integral structures are diffusion bonded together.

In a further alternative it is possible to stack up the integral structures 40 and integral structures 50 with the associated frames 28 alternately until the required number of structures is achieved. Then the integral structures 50 are superplastically formed and the integral structures 40, integral structures 50 and frames 28 are diffusion bonded together.

Figure 5:
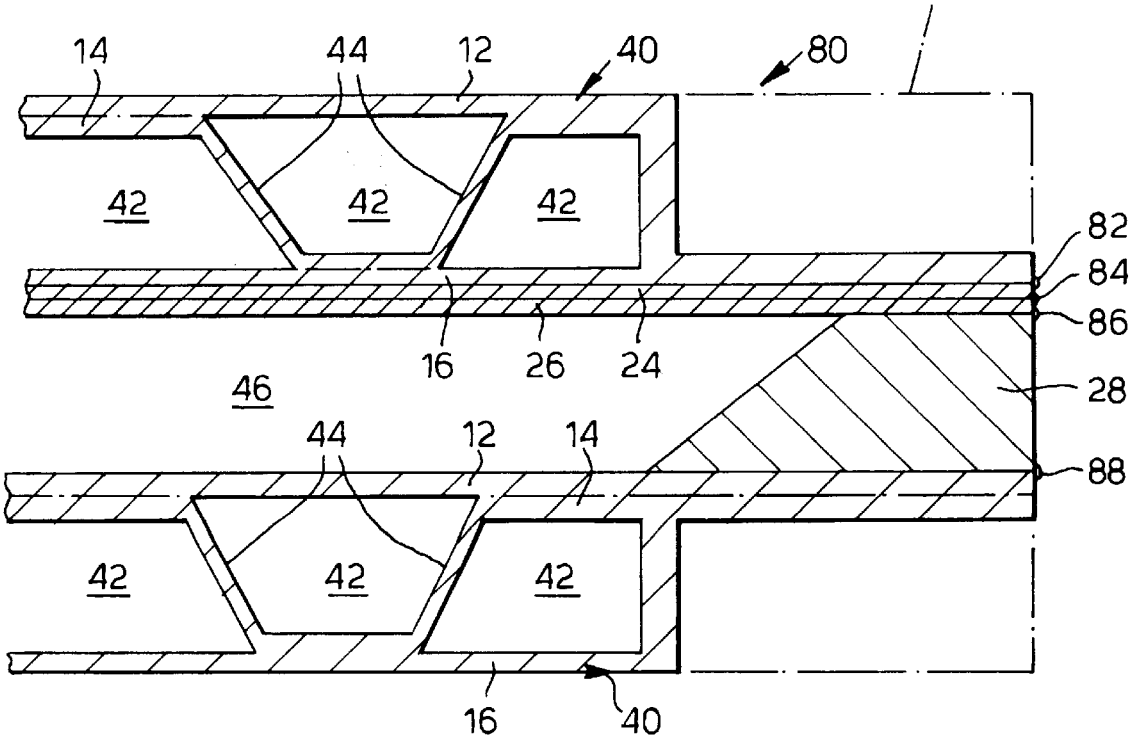
FIG. 5 is a part view of a module comprising two, three sheet, integral structures made from the stack of FIG. 1 sandwiching two sheets and a frame.

Referring to FIG. 5. The two, three sheet, integral structures 40, two sheets of titanium 24 and 26 are now assembled into a single module 80 together with a titanium frame 28. The two sheets 24 and 26 and the frame 28 are sandwiched between the two, three sheet, integral structures 40. The titanium frame 28 abuts the periphery of one major face of the under sheet 26 and abuts the periphery of one major face of one of the ex sheets, in the present example, the top sheet 12 of one of the integral structures 40. The major face of the top sheet 24 abuts the major face of one of the ex sheets, in this example, the under sheet 16 of the other integral structure 40.

The module 80 is then welded around its edges at 82,84 86 and 88 to seal the space between one of the integral structures 40 and the sheet 24, to seal the space defined between the sheets 24 and 26, to seal the space between the sheet 26 and the frame 28 and to seal the space between the other integral structure 40 and the frame 28.

The resulting module 80 of two integral structures 40, or panels, sheets 24 and 26 and frame 28 are placed in a die and the whole is heated to a temperature suitable for superplastic forming, about 900 degrees C. for titanium. An inert gas such as argon is introduced into the areas between the sheets 24 and 26 containing the yttria in known manner via the aforementioned pipes (not shown), and the inert gas is introduced into the rows of passageways 42 in each of the integral structures 40. The space 46 defined between the other integral structure 40, the sheet 26 and the frame 28 is evacuated.

The inert gas is introduced into the areas between the sheets 24 and 26 containing the yttria and the rows of passageways 42 in the integral structures 40 such that the under sheet 26 superplastically extends to abut against the frame 28 and against the surface of the ex sheet 12 of the lower integral structure 40 before the sheet 24 diffusion bonds with the ex sheet 16 of the upper integral structure 40 and the sheet 26 diffusion bonds with the ex sheet 12 of the lower integral structure 40 and the frame 28 diffusion bonds with the lower integral structure 40 to form an integral module and to ensure that the integral structures 40 do not become deformed.

The faying faces of the upper integral structure 40 and the sheet 24 are diffusion bonded over their total areas, so as to form a thicker structure portion. The frame 28 diffusion bonds to the lower integral structure 40 and a single passageway results, which is defined between the sheets 24 and 26. The sheet 24 is diffusion bonded to the upper integral structure 40 and sheet 26 is diffusion bonded to the frame 28 and the lower integral structure 40 and the periphery of sheet 24 is diffusion bonded to the periphery of sheet 26. The sheet 26 only superplastically extends where it is forced onto the inner surface of the ex frame 28.

As an alternative to the seals 82,84,86 and 88 it is possible to simply position plates over the edges of the integral structures 40, sheets 24, 26 and frames 28 and to weld the abutting edges of the plates together and to weld the edges of the plates to the integral structures 40 so as to form a sealed assembly.

In a further alternative it is possible to stack up the integral structures 40 and two further sheets 24 and 26 with the associated frames 28 alternately until the required number of structures is achieved. Then each of the further sheets 26 is superplastically formed and the integral structures 40, further sheets 24 and 26 and frames 28 are diffusion bonded together.

This embodiment has the further advantage of combining the bonding of the two sheets and the superplastic forming of the two sheets with the bonding of the integral stacks into an integral module, thus dispensing with the requirement to initially diffusion bond the two sheets into an integral structure.

It is preferred to supply an inert gas such as argon into the areas of the integral structure 22 containing the yttria in known manner via the aforementioned pipes (not shown), at room temperature while the ex sheets 24 and 26 are elastic to break the adhesive bond between the ex sheets 24 and 26 due to the diffusion bonding step, before the superplastic forming step, to ensure that the ex sheet 26 superplastically extends to abut the sheet 12 before diffusion bonding occurs.

It may be possible to place the three sheet stacks and two sheet stacks into a vacuum chamber and heat the stacks to remove the volatile binders from the anti diffusion bonding material before the edges of the stacks are weld sealed, for example by an electron beam or laser beam as described in UK patent No. 2256389B. A further possibility is to place the three sheet stacks and two sheet stacks between a pair of pressurisable chambers in a vacuum chamber and heat the stacks to remove the volatile binders from the anti diffusion bonding material. The stacks are then heated and the pressure in the pressurisable chambers is increased to diffusion bond the sheets together as described in UK patent application Nos. 2260923B and 2280867B.

I claim:

1. A method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) preparing two further sheets of a superplastically formable metal, at least one of which has a major portion of its faying face coated with a said anti diffusion bonding material such as to leave a peripheral area thereof exposed and preparing a frame formed from a superplastically formable metal, f) stacking the two, three sheet, integral structures, the two further sheets and the frame such that the two further sheets and the frame are sandwiched between the two, three sheet, integral structures, g) sealing the abutting edges of the two, three sheet, integral structures, the two further sheets and the frame to form a module, h) placing the module in an appropriately shaped die and heating the module to a temperature conducive to superplastic forming, and then i) applying an inert gas under pressure into the rows of internal passageways of the two, three sheet, integral structures and between those faying faces of the two further sheets where anti diffusion bonding material was applied, so that one of the two further sheets moves away from the other of said two further sheets, to form a single passageway centrally of the whole and to diffusion bond the two, three sheet, integral structures, the two further sheets and the frame together to form an integral module.

2. The method of claim 1 wherein step (e) includes stacking the two further sheets together, diffusion bonding each separate two sheet stack to form an integral structure and applying the frame to the periphery of the outer surface of one of said two sheets of the two sheet integral structure, step (f) includes stacking the two, three sheet, integral structures, with the two sheet integral structure and the frame sandwiched therebetween, and step (i) includes applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

3. The method of claim 1 wherein step (e) includes stacking the two further sheets together, locating the frame between the peripheries of the inner surfaces of said two sheets of the two sheet stack, diffusion bonding each separate two sheet stack and frame to form an integral structure, step (f) includes stacking the two, three sheet, integral structures, with the two sheet integral structure and frame sandwiched therebetween, and step (i) includes applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

4. The method of claim 1 wherein step (e) includes stacking the two further sheets together, applying the frame to the periphery of the outer surface of one of said two sheets, step (f) includes stacking the two, three sheet, integral structures, with the two further sheets and the frame sandwiched therebetween, step (i) includes applying an inert gas under pressure into the rows of internal passageways of the three sheet integral structures and between those faying faces of the two further sheets where anti diffusion bonding material was applied, so that one of the two further sheets moves away from the other of said two further sheets, to form a single passageway centrally of the whole and to diffusion bond the three sheet integral structures, the two further sheets and the frame together to form an integral module.

5. The method of claim 1 including the step of using titanium or an alloy thereof as the superplastically formable metal.

6. The method of claim 1 including the step of using argon as the inert gas.

7. The method of claim 1 including the step of using yttria as the anti diffusion bonding material.

8. The method of claim 1 including the step of using different alloys for the three sheets in step (a) and the two further sheets used in step (e).

9. The method of claim 1 including the step of using different alloys for the three sheet stack in step (a) and the frame in step (e).

10. The method of claim 2 or claim 3 including the step of supplying inert gas into the two sheet integral structure at a temperature at which the sheets are plastic to break the adhesive bond between the sheets.

11. The method of claim 1 including weld sealing each three sheet stack around their edges after step (a) and before step (b).

12. The method of claim 2 or claim 3 including weld sealing each two sheet stack around their edges before diffusion bonding.

13. The method of claim 1 wherein step (e) includes locating at least one turbulator between the one of the two further sheets abutting the frame and the integral structure.

14. The method of claim 13 including the step of using different alloys for the at least one turbulator and the three sheet stack in step (a).

15. The method of claim 13 including the step of using different alloys for the at least one turbulator and the two further sheets of step (e).

16. A method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) stacking two further sheets of a superplastically formable metal, at least one of which has a major portion of its faying face coated with a said anti diffusion bonding material such as to leave a peripheral area thereof exposed, f) diffusion bonding each separate two sheet stack to form an integral structure, g) applying a frame formed from a superplastically formable metal to the periphery of the outer surface of one of said two sheets of the two sheet integral structure, h) stacking the two, three sheet, integral structures, with the two sheet integral structure and frame sandwiched therebetween, i) weld sealing the edges of one of the three sheet integral structures to the frame, weld sealing the edges of the two sheet integral structure to the frame and weld sealing the edges of the other three sheet integral structure to the two sheet integral structure to form a module, j) placing the module in an appropriately shaped die and heating the module to a temperature conducive to superplastic forming, and then k) applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

17. A method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) stacking two further sheets of a superplastically formable metal, at least one of which has a major portion of its faying face coated with a said anti diffusion bonding material such as to leave a peripheral area thereof exposed, locating a frame formed from a superplastically formable metal between the peripheries of the inner surfaces of said two sheets of the two sheet stack, f) diffusion bonding each separate two sheet stack and frame to form an integral structure, g) stacking the two three sheet integral structures, with the two sheet integral structure and frame sandwiched therebetween, h) weld sealing the edges of one of the three sheet integral structures to the two sheet integral structure and weld sealing the edges of the other three sheet integral structure to the two sheet integral structure to form a module, i) placing the module in an appropriately shaped die and heating the module to a temperature conducive to superplastic forming, and then j) applying an inert gas under pressure into the rows of internal passageways of the three sheet integral structures and between those faying faces of the two sheet integral structure where anti diffusion bonding material was applied, so that one of the former sheets of the former two sheet stack moves away from the other former sheet of said former two sheet stack, to form a single passageway centrally of the whole and to diffusion bond the three sheet integral structures, the two sheet integral structure and the frame together to form an integral module.

18. A method of manufacturing a heat exchanger comprises the steps of:

a) stacking two lots of three sheets of a superplastically formable metal, at least the centre sheet of each lot having had an anti diffusion bonding substance applied in desired local places, b) diffusion bonding each separate three sheet stack to form two integral structures, c) heating each integral structure to a temperature conducive to superplastic forming, d) applying an inert gas under pressure between those faying faces where anti diffusion bonding material was applied, so that those portions formed from the former outer sheets move away from the former centre sheets at those places, pulling with them the opposing portions of the former centre sheets where diffusion bonding has been effected to form a row of internal passageways, e) stacking two further sheets of a superplastically formable metal, at least one of which has a major portion of its faying face coated with a said anti diffusion bonding material such as to leave a peripheral area thereof exposed, f) applying a frame formed from a superplastically formable metal to the periphery of the outer surface of one of said two sheets, g) stacking the two, three sheet, integral structures, with the two further sheets and the frame sandwiched therebetween, h) weld sealing the edges of one of the three sheet integral structures to the frame, weld sealing the edges of one of the two further sheets to the frame, weld sealing the edges of the two further sheets and weld sealing the edges of the other three sheet integral structure to the other of the two further sheets to form a module, j) placing the module in an appropriately shaped die and heating the module to a temperature conducive to superplastic forming, and then k) applying an inert gas under pressure into the rows of internal passageways of the three sheet integral structures and between those faying faces of the two further sheets where anti diffusion bonding material was applied, so that one of the two further sheets moves away from the other of said two further sheets, to form a single passageway centrally of the whole and to diffusion bond the three sheet integral structures, the two further sheets and the frame together to form an integral module.

* * * * *